United States Patent [19]

Toudo et al.

[11] Patent Number: 4,605,863

[45] Date of Patent: Aug. 12, 1986

[54] DIGITAL CONTROL CIRCUIT

[75] Inventors: Kenzi Toudo; Motoshi Yiyanaka; Yoshiki Hayata, all of Yanai, Japan

[73] Assignee: Hitachi, Ltd., Tokyo, Japan

[21] Appl. No.: 536,501

[22] Filed: Sep. 28, 1983

[30] Foreign Application Priority Data

Oct. 27, 1982 [JP] Japan ..... 57-187419

[51] Int. Cl.[4] ..... H03K 3/00; H03K 5/19; G01R 29/027

[52] U.S. Cl. ..... 307/269; 307/360; 307/592; 307/597; 307/296 A; 431/24

[58] Field of Search ..... 307/200 A, 200 B, 592, 307/597, 350, 354, 360, 269, 296 R, 296 A; 328/120, 69, 70, 72, 74, 75; 431/18, 24, 25, 29, 30, 73

[56] References Cited

U.S. PATENT DOCUMENTS

| | | | |
|---|---|---|---|
| 3,737,744 | 6/1973 | Bader, Jr. | 307/200 A |
| 4,145,179 | 3/1979 | Tanaka et al. | 431/29 |
| 4,274,553 | 6/1981 | Evers et al. | 307/350 |
| 4,319,873 | 3/1982 | Michaud et al. | 431/24 |
| 4,389,184 | 6/1983 | Tanaka et al. | 431/73 |
| 4,434,403 | 2/1984 | Chang | 307/350 |

*Primary Examiner*—John Zazworsky

*Attorney, Agent, or Firm*—Antonelli, Terry & Wands

[57] ABSTRACT

The present invention relates to a digital control circuit which controls the drive of a load by the use of a clock pulse. More particularly, it relates to an integrated circuit device for combustion control which controls the combustion of a burner in a water heater, an air heater or the like. A combustion control circuit performs an ignition operation for a predetermined time, and stops the supply of fuel in case of misfire. When the reception of the time-keeping clock pulses has stopped within the predetermined time, such predetermined time will become infinite, and in the case of misfire, the fuel supply will continue dangerously. According to the present invention, a capacitor is charged by the output clock pulse of a circuit for shaping the waveform of the received clock pulse, an buffer circuit prevents the discharge of the capacitor toward the pulse shaping circuit when the clock pulse is at its low level, a discharge circuit for discharging the capacitor at this time is connected in parallel with the capacitor, and a voltage detecting circuit detects the voltage of the capacitor so that, when the capacitor voltage is unequal to a preset voltage, the combustion operation may be stopped by the output of the voltage detecting circuit. The constituents other than the capacitor are disposed within the integrated circuit device.

15 Claims, 6 Drawing Figures

DIGITAL CONTROL CIRCUIT

BACKGROUND OF THE INVENTION

The present invention relates to a digital control circuit which controls the drive of a load on the basis of clock pulses. More particularly, it relates to a combustion control circuit for controlling the combustion of a burner in a water heater, an air heater or the like.

Combustion control circuits of the specified type are described in, for example, U.S. Pat. No. 4,145,179 and International Patent Application Laid-open No. WO 80/01604 (International Application No. PCT/JP80/00008, U.S. patent application Ser. No. 224,289).

The arrangement and operations of a combustion control circuit of this type will be explained with reference to FIGS. 1 and 2. Numeral 1 designates an integrated circuit device for combustion control, which is, e.g., 'HA16605W' produced by Hitachi Ltd. The integrated circuit device 1 is provided with power supply input terminals 2*a* and 2*b*, an input terminal 3 for a clock pulse, an input terminal 4 for a flame detection signal, an input terminal 5 for a temperature detection signal, an output terminal 6 for driving a blower, an output terminal 7 for driving an ignition circuit, an output terminal 8 for driving a fuel valve, and an output terminal 9 for driving a safety device. It includes therein a timer 11 which keeps time by counting the clock pulses of the input terminal 3, and a control circuit 12 which supplies the output terminals 6, 7, 8 and 9 with driving signals at their respective timings on the basis of the signals of the input terminals 4 and 5 and signals from the timer 11.

Numeral 13 designates an A.C. source, numeral 14 a D.C. source circuit, numeral 15 an operation switch, numeral 16 a diode, numerals 17 and 18 voltage dividing resistors, and numeral 19 a noise preventing capacitor.

The operations of such arrangement will now be explained with reference to FIG. 2. Numerals at the left end of FIG. 2 correspond to those in FIG. 1. When the operation switch 15 is turned "on" and the input terminal 5 receives a signal indicating that the temperature of a load is lower than a preset value (at time $t_0$), the control circuit 12 causes the timer 11 to start keeping time. The input terminal 3 is supplied with clock pulses obtained through the half-wave rectification of the alternating current of the A.C. source 13. The timer 11 begins to count the clock pulses from the input terminal 3. Thus, a prepurge period is started. At this time, the control circuit 12 delivers a driving signal to the output terminal 6 so as to start a prepurge operation.

When the timer 11 has counted a predetermined number of clock pulses, it supplies the control circuit 12 with an output, in response to which the control circuit 12 delivers driving signals to the output terminals 7 and8 so as to start an ignition operation (at time $t_1$). Meanwhile, the timer 11 continues the counting operation. A safety period begins at the time $t_1$. When a signal indicating the existence of a flame has been receives at the input terminal 4 (at time $t_2$) within the safety period ($t_1$–$t_4$), the control circuit 12 stops the driving signal of the output terminal 7 so as to establish a normal combustion state. If the flame detection signal 4 disappears, that is, if the flame is extinguished in the normal combustion state, the combustion is restarted from the prepurge operation by way of example. Further, if the load temperature exceeds a predetermined value in the normal combustion state so that the temperature detection signal 5 disappears, the control circuit 12 stops the combustion.

If the flame detection signal is not received within the safety period, the operation is repeated from the beginning of the prepurge operation. Alternatively, as indicated by broken lines in FIG. 2, the control circuit 12 stops delivering the driving signals of the output terminals 6, 7 and 8 and delivers an alarm signal from the output terminal 9 at the time $t_4$, to stop the combustion operation.

When, as illustrated at (8), (4), (9) and (3) in the lower part of FIG. 2, the input terminal 3 is grounded or electrically disconnected accidentally or intentionally at the time $t_3$ within the safety period, no clock pulse is received, and hence, the safety period is prolonged infinitely. This is very dangerous because fresh fuel may continue to be released in case of misfire (assuming that the D.C. source is kept energized).

The situation is similar in a case where the input terminal 3 is pulled up due to its contact with any other higher voltage part and where the ignition is not effected.

Regarding a circuit wherein the reception of an external signal, the delivery of an external signal or the exchange of an internal signal is performed in synchronism with a clock pulse, the interruption of the reception of the clock pulse causes a problem because the circuit becomes incapable of operating. For example, in a circuit wherein the signal of the input terminal 4 is received in synchronism with the clock pulse, even when a signal indicating the extinguishing of a flame has been received, the control circuit 12 cannot supply the output terminal 8 with a stop signal for the fuel valve without receipt of the clock pulse, so that the release of fuel is continued.

As a measure against this drawback, a second timer has been installed separately from the integrated circuit device 1. It is also designed to furnish the integrated circuit device 1 with two input terminals for the clock pulses. In either case, however, the cost is high.

On the other hand, U.S. patent application Ser. No. 458,454 has proposed an expedient according to which a clock pulse having a predetermined bias voltage is impressed on the clock pulse input terminal of an integrated circuit device, a circuit for detecting the presence or absence of the bias voltage is disposed in the integrated circuit device, and the operation is stopped in the absence of the bias voltage.

SUMMARY OF THE INVENTION

An object of the present invention is to provide a digital control circuit whch avoids any unsafe state upon detecting the fact that a clock pulse has failed to be received.

According to one aspect of performance of the present invention, a digital control circuit comprises a capacitor which is charged by a clock pulse, and a voltage detector circuit which detects any abnormal voltage of the capacitor, so that the operation may be stopped by the output of the voltage detector circuit when the charged voltage of the capacitor is unequal to a preset voltage.

BRIEF DESCRIPTION OF THE DRAWINGS

FIG. 1 is a circuit diagram of a prior-art combustion control circuit, while

DESCRIPTION OF THE PREFERRED EMBODIMENTS

Figure 1:
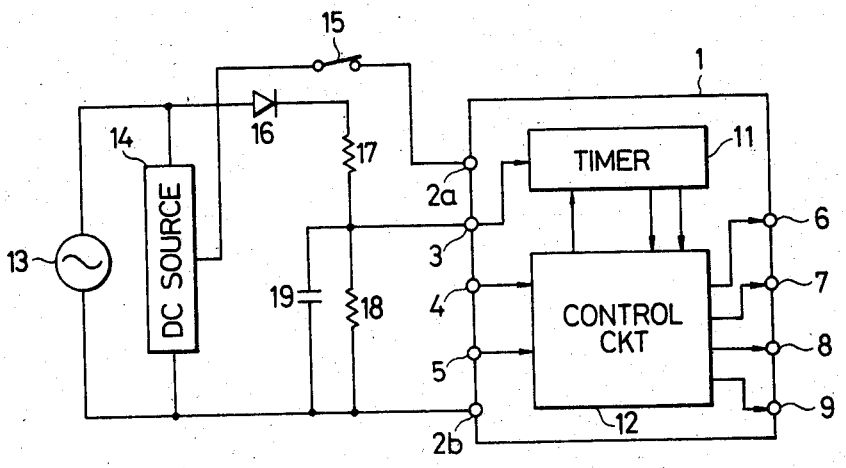
FIG. 1 PRIOR ART
Figure 3:
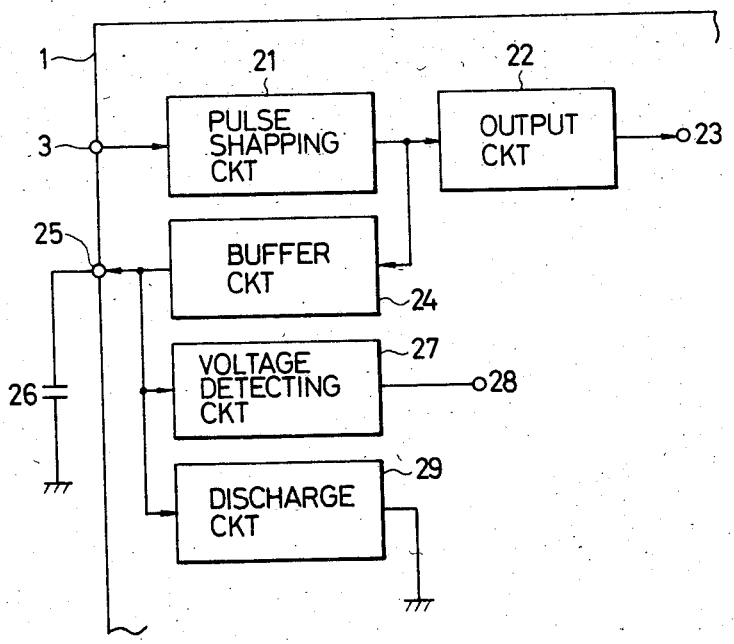
FIG. 3 is a fundamental block diagram of an embodiment of the present invention.
Figure 2:
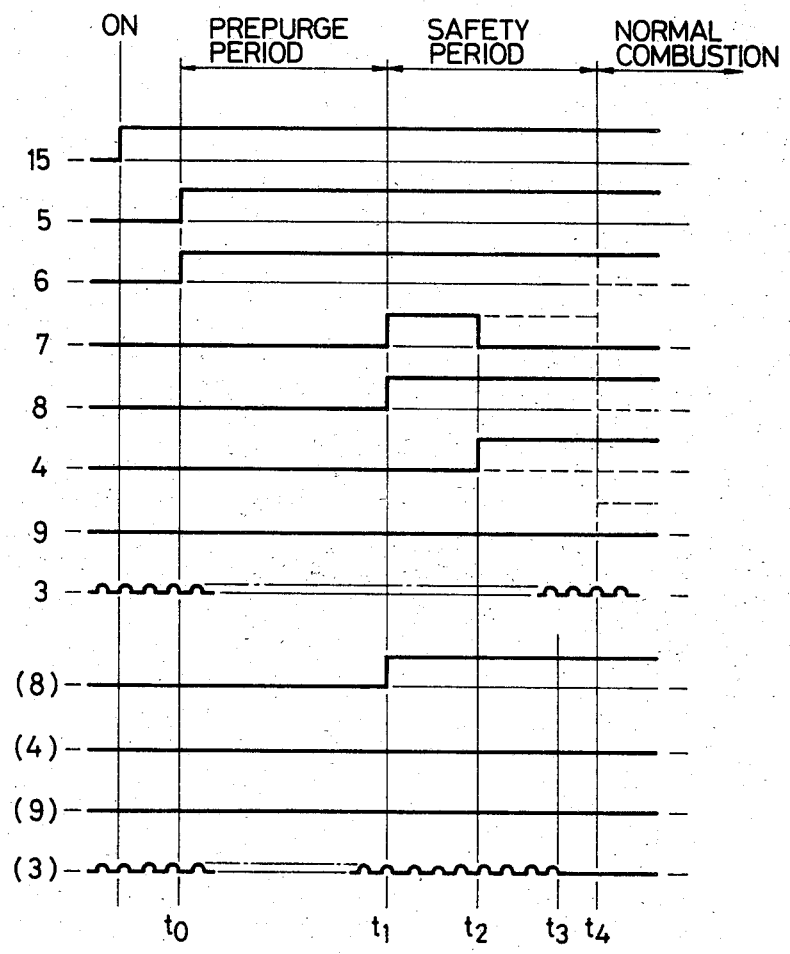
FIG. 2 is a diagram for explaining the operation of the circuit in FIG. 1.
Figure 4:
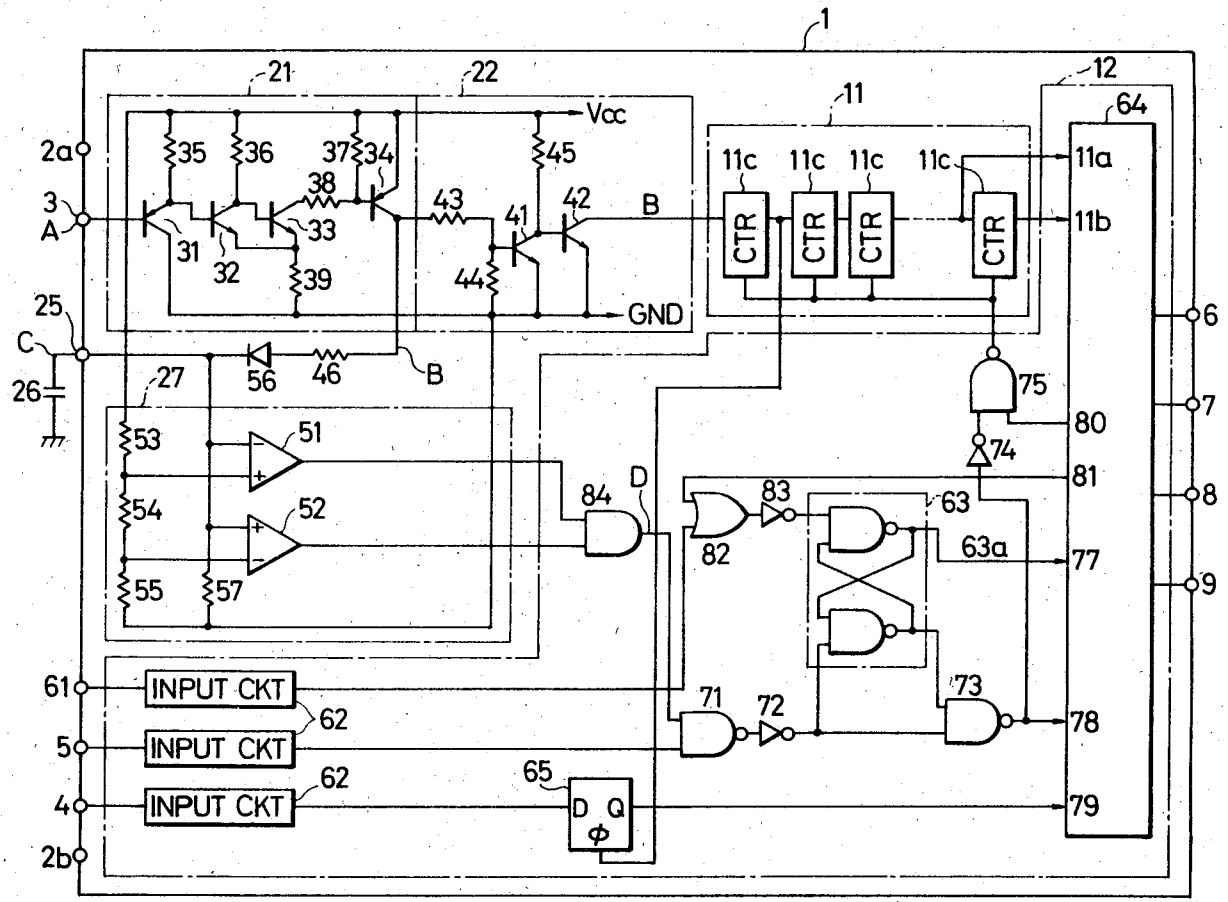
FIG. 4 is a circuit diagram of an integrated circuit device for combustion control in an embodiment of the present invention.

The present invention will be described in conjunction with an embodiment shown in FIGS. 3 and 4. FIG. 3 shows a fundamental arrangement corresponding to FIG. 4.

Referring to FIG. 3, a clock pulse at an input terminal 3 obtained through half-wave rectification has its waveform shaped by a pulse shaping circuit 21, the output of which is passed through an output circuit 22 and then applied from an output terminal 23 to the frequency divider circuit of a timer 11. This arrangement is well known. The output of the pulse shaping circuit 21 is also applied to a capacitor 26 outside an integrated circuit device 1 through a buffer circuit 24 and an input terminal 25, so as to charge the capacitor. Shown at numeral 27 is a voltage detecting circuit which detects any abnormal voltage of the input terminal 25, and the output terminal 28 of which is connected to a control circuit 12. The control circuit 12 stops the operation in response to the output of the abnormal voltage from the voltage detecting circuit 27. When the output of the pulse shaping circuit 21 is at its low level, the buffer circuit 24 prevents the charges of the capacitor 26 from discharging to the output circuit 22. At this time, the charges of the capacitor 26 are discharged through a discharge circuit 29 so as to hold the voltage of the capacitor 26 at a predetermined magnitude. When the predetermined clock pulse has failed to be received due to electric disconnection, grounding or the like of the input terminal 3, the voltage of the capacitor 26 becomes unequal to the preset voltage thereof. Therefore, the voltage detecting circuit 27 detects this situation and delivers an abnormality detection signal to the output terminal 28 so as to stop the operation.

The circuits 21, 22, 24, 27 and 29 other than the capacitor 26 are disposed in the integrated circuit device 1.

A practicable embodiment will now be described with reference to FIG. 4. This embodiment is adapted to check grounding, electrical disconnection and pull-up.

The pulse shaping circuit 21 is composed of transistors 31, 32, 33 and 34 and resistors 35, 36, 37, 38 and 39. The output circuit 22 is composed of transistors 41 and 42 and resistors 43, 44 and 45. Shown at numeral 46 is a charge resistor. The pulse shaping circuit 21 and the output circuit 22 are demarcated for the sake of convenience.

The voltage detecting circuit 27 comprises two voltage comparator circuits 51 and 52, each of which has a wellknown arrangement. The voltage comparator circuit 51 serves to detect the grounding of the input terminal 3, while the voltage comparator circuit 52 serves to detect the electrical disconnection and pull-up of the input terminal. Each of the outputs of the voltage detector circuits 51 and 52 is at its high level for the normal voltage of the capacitor 26, and is at its low level for an abnormal voltage of the capacitor 26. Resistors 53, 54 and 55 set the reference voltages of the voltage comparator circuits 51 and 52. Numeral 56 indicates a diode as the buffer circuit 24, and numeral 57 a resistor as the discharge circuit 29.

The timer 11 consists of a plurality of frequency divider circuits. It delivers a prepurge end signal from a terminal 11*a*, and a safety period end signal from a terminal 11*b*.

Numeral 61 denotes an input terminal for an abnormality detection signal, to which the signal of low level is applied in case of the abnormality. An input terminal 5 is supplied with a signal of low level in a case where the temperature of a load is lower than a preset value. An input terminal 4 is supplied with a signal of low level in a case where a flame exists. Input circuits 62 invert the inputs and provide the inverted signals.

Shown at numeral 63 is an R-S flip-flop, the output 63*a* of which becomes high level in an alarm state. A controller 64 has a known circuit arrangement. In the alarm state, it provides stop signals for respective equipment from output terminals 6, 7 and 8 and also provides an alarm signal from an output terminal 9. Shown at numeral 65 is a D-type flip-flop, which provides a flame signal in synchronism with the rise of a clock pulse delivered from the counter 11*c*.

The operations of such circuit arrangement will now be described. Hereinbelow, the low level shall be written "L", and the high level "H".

First, there will be explained a case where the various portions are under normal conditions including, for example, that an operation switch 15 is closed and that the clock pulse is properly received. Since the clock pulse is received, the outputs of the voltage comparator circuits 51 and 52 are H, and the output of an AND gate 84 is H.

In a case where the temperature of the load is higher than the preset point, the input terminal 5 is at H, and hence, a NAND gate 71 becomes H, an inverter 72 L and a NAND gate 73 H. In addition, the output of the R-S flip-flop 63 becomes L, and this R-S flip-flop is reset. In accordance with signals at the input terminals 77 and 78, the controller 64 delivers the stop and alarm signals to the output terminals 6, 7, 8 and 9.

When the temperature of the load has become lower than the preset point, the input terminal 5 becomes L, the inverter 72 H and the NAND gate 73 L, and the controller 64 supplies the output terminal 6 with a blower driving signal and also an output terminal 80 a signal of H. In addition, an inverter 74 becomes H and a NAND gate 75 L, so that the timer 11 starts operating. Thus, a prepurge period is started.

When the output terminal 11a has become H, the controller 64 supplies the output terminals 7 and 8 with driving signals so as to feed fuel and to actuate an ignitor. Thus, a safety period is started.

When the burner has been ignited, the input terminal 4 receives a signal of L, which is applied to the input terminal 79 of the controller 64 through the D-type flip-flop 65. Upon acknowledging the ignition, the controller 64 stops the operation of the ignitor. In addition, the output terminal 80 becomes L, and the NAND gate 75 H, so that the operation of the timer 11 is stopped.

When the burner is not ignited within the safety period, the output terminal 11b becomes H, so that the controller 64 supplies stop signals to the output terminals 6, 7 and 8. Since the controller simultaneously provides a signal of H at its output terminal 81, an OR gate 82 becomes H and an inverter 83 L, and the R-S flip-flop 63 is set to provide a signal of H at the output terminal 63*a*. Thus, the output statuses of the stop signals at the output terminals 6, 7 and 8 are held, and the alarm signal is kept applied to the output terminal 9.

Also in a case where the input terminal 61 has received a signal of L on account of the occurrence of any external abnormal condition, the OR gate 82 becomes L.

In a case where a flame has been extinguished during normal combustion, the input terminal 4 receives a signal of L. The D-type flip-flop 65 sends this signal to the controller 64 in synchronism with the rise of the clock pulse delivered from the counter 11*c*. The controller 64 supplies the output terminal 8 with a stop signal for a fuel valve, to bring the combustion operation back to the prepurge operation.

Figure 5:
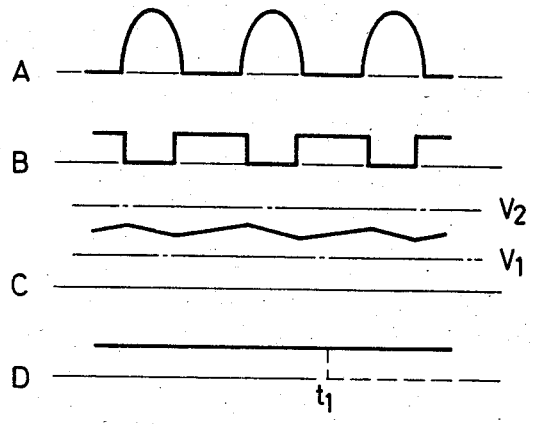
FIG. 5 is a diagram showing the operating waveforms of several parts in FIG. 4.

In the next place, a case where the reception of the clock pulse has stopped will be described with reference to FIG. 5. Letters A, B, C and D in FIG. 5 illustrate waveforms at parts A, B, C and D in FIG. 4, respectively.

The transistor 34 of the pulse shaping circuit 21 turns "on" and "off" in accordance with the clock pulses A of the input terminal 3 as illustrated at B. When the transistor 34 is "on", the capacitor 26 is charged through the resistor 46 and the diode 56. In contrast, when the transistor 34 is "off", the capacitor 26 has its charges discharged through the resistor 57. Accordingly, the charges of the capacitor 26 are held at a predetermined voltage as illustrated at C. The diode 56 prevents any influence on the output circuit 22 during the turn-off time of the transistor 34.

When the signal of H at the input terminal 3 continues on account of the disconnection between the input terminal 3 and, e.g., a clock pulse generator circuit (not shown), the "off" state of the transistor 34 is continued, and the charges of the capacitor 26 are discharged. Therefore, the voltage of the capacitor 26 becomes lower than a value $V_1$, and the output of the voltage comparator circuit 52 becomes L.

On the other hand, when the signal of L at the input terminal 3 continues on account of the grounding of this input terminal, the "on" state of the transistor 34 is continued, and the charging of the capacitor 26 is continued. Therefore, the voltage of the capacitor 26 becomes higher than a value $V_2$, and the output of the voltage comparator circuit 51 becomes L.

In the case of the pull-up of the input terminal 3, the voltage comparator circuit 52 becomes L.

When the input terminal 25 has been disconnected or grounded, or when the conduction of the capacitor 26 has gotten out of order, the voltage comparator circuit 52 becomes L. On the other hand, when the input terminal 25 has been pulled up, the voltage comparator circuit 51 becomes L.

When the output of the voltage comparator circuit 51 or 52 has become L due to any of the situations described above, the NAND gate 84 becomes L and the NAND gate 71 becomes L. Since this status is identical to the status for the load temperature exceeding the preset point, the output terminals 6, 7 and 8 are supplied with the stop signals, and the combustion operation is stopped.

A broken line drawn at D in FIG. 5 illustrates that, at time $t_1$, the voltage of the point C has become below $V_1$ or above $V_2$, so the AND gate 84 has become L.

Accordingly, even when the clock pulse is not received under the unignited condition within the safety period, the operation can be stopped, and any danger can be prevented.

In a case where no clock pulse is received and where the flame has been extinguished, the operation is stopped owing to the above arrangement, and hence, the continuation of the release of fuel can be prevented.

When the input terminals 3 and 25 have short-circuited, the voltage comparator circuit 52 becomes L to stop the operation. Accordingly, there is no problem posed by the addition of the input terminal 25.

Only when the clock pulses of the input terminal 3 can be read, the pulse shaping circuit 21 operates to provide the clock pulses as shown at B in FIG. 5, and the timer 11 etc. are adapted to operate in accordance with the clock pulses B. In contrast, when a clock pulse outside a predetermined range, which cannot be read by the pulse shaping circuit 21 is received, the pulse shaping circuit 21 stops operating, and the transistor 34 continues its "on" or "off" state. Accordingly, whenever an abnormal clock pulse is received, the operation can be stopped.

Besides, although the clock pulse to be impressed on the input terminal 3 changes greatly due to the fluctuation of a supply voltage, etc., the output of the pulse shaping circuit 21 exhibits a small width of change. Since the capacitor 26 is charged with this output of the pulse shaping circuit 21, a stable voltage level is obtained across the capacitor 26, and any abnormal voltage can be precisely checked.

Thus, only when the clock pulse is not applied to the timer 11 etc., the operation can be stopped, so the operation is prevented from being unnecessarily stopped. Moreover, whenever the clock pulse is not applied to the timer 11 etc., the operation can be stopped.

It is also considered to derive the charging clock pulse from the output circuit 22.

In the present invention, disconnection and grounding within the integrated circuit device 1 are tentatively left out of consideration. Since, however, the output of the pulse shaping circuit 21 is used for the detecting of the clock pulse, the operation can be stopped also when any abnormality has arisen in the pulse shaping circuit 21.

In addition, since the diode 56, voltage detecting circuit 27 and resistor 57 are built in the integrated circuit device, the digital control circuit can be fabricated inexpensively, can prevent these constituents from being short-circuited, grounded or disconnected by intentional and accidental reasons, and can make it sufficient to provide the single input terminal for abnormality detection. When the constituents are disposed outside the integrated circuit device, a corresponding effect can be achieved though the safety lowers. Disposing the resistor 57 outside is safe because the voltage comparator circuits 51 and 52 operate when it is disconnected or conducted.

During the operation of the voltage detecting circuit 27, the operations of the digital control circuit are made equivalent to those in the case where the load temperature is higher than the preset point. Since, however, this circuit is the combustion control circuit, it may be constructed, at least, so as to stop the fuel supply.

Until the capacitor 26 is charged and the output of the voltage comparator circuit 52 becomes H after the operation switch 15 has been closed, the digital control circuit is held in a status equivalent to that in the case of the load temperature higher than the set point, and it starts no operation. This period of time, however, forms no hindrance because it is short and the digital control circuit subsequently starts the ignition operation. If the circuit is so arranged that the R-S flip-flop 63 is set by the output of the AND gate 84, the ignition operation cannot be started.

Figure 6:
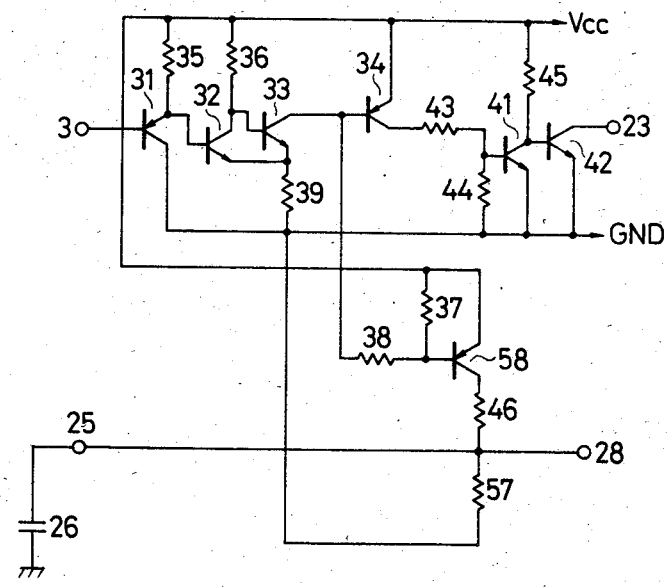
FIG. 6 is a circuit diagram of the essential portions in another embodiment of the present invention.

FIG. 6 illustrates another embodiment which does not employ the diode 56. A transistor 58 is disposed as shown in the figure, to separate a clock pulse for the timer 11 and a clock pulse for the capacitor 26, whereby the charges of the capacitor 26 are prevented from affecting the transistor 34.

As understood from this embodiment, a waveshaping circuit to be used exclusively for charging may be provided as well. In this case, the transitor of the output stage of the waveshaping circuit has the function of the buffer circuit 24.

While the timer 11 in each of the embodiments has been composed of the frequency divider circuits, this measure can be similarly utilized in a digital control circuit in which the integrated circuit device 1 is constructed of a microcomputer.

While the embodiments have been the combustion control circuits, the invention can also be utilized or other control devices.

In each of the embodiments, when it is unnecessary to detect the fault of grounding by way of example, the voltage detector circuit 51 can be dispensed with.

As set forth above, the present invention consists in that a capacitor is disposed so as to be charged by a clock pulse, that an interrupter circuit for preventing discharge from the capacitor toward an output terminal to deliver the clock pulse to the capacitor is disposed between the capacitor and the output terminal, that a voltage detector circuit for detecting the voltage of the capacitor and a discharge circuit for holding the charges of the capacitor at a predetermined magnitude are disposed between the capacitor and the interrupter circuit, that the voltage detector circuit is constructed so as to provide a second signal when the charged voltage of the capacitor is unequal to a preset voltage, and that control means is disposed so as to stop the operation for controlling a load, in accordance with the second signal. Owing to a very simple arrangement, therefore, any unsafe state can be avoided when the clock pulse has failed to be received.

We claim:

1. A digital control circuit comprising means for providing a clock pulse signal of predetermined magnitude; control means responsive to said clock pulse signal and at least one control signal for generating a first signal for controlling a load; means including a capacitor connected to said clock pulse signal providing means through a charge resistor for causing said capacitor to be charged by said clock pulse signal to a voltage level determined by the magnitude of the pulses of said clock pulse signal; discharge means including a discharge resistor connected in parallel to said capacitor for holding the charge on said capacitor at said predetermined level when said capacitor is receiving said clock pulse signal of predetermined magnitude; voltage detecting means connected to said capacitor for detecting the voltage of said capacitor and including means for generating a second signal when the charged voltage of said capacitor is unequal to a preset voltage; and means connected to said voltage detection means for preventing generation of said first signal by said control means in response to receipt of said second signal.

2. A digital control circuit according to claim 1, wherein buffer means is connected between the output of said clock pulse signal providing means and said capacitor for preventing said capacitor from discharging toward the output of said clock pulse signal providing means.

3. A digital control circuit according to claim 2, wherein at least said voltage detecting means and said buffer means are formed as an integrated circuit.

4. A digital control circuit according to 2, wherein said discharge means comprises means for discharging said capacitor when the magnitude of said clock pulse signal falls below said predetermined magnitude.

5. A digital control circuit according to claim 2, wherein said buffer means comprises a diode.

6. A digital control circuit according to claim 2, wherein said buffer means comprises a transistor having a base electrode connected to the output of said clock pulse signal providing means and a collector connected to said capacitor.

7. A digital control circuit according to claim 2, wherein said means for providing said clock pulse signal comprises pulse shaping means connected to receive a pulse signal for shaping said pulse signal into a clock pulse signal of predetermined magnitude.

8. A digital control circuit according to claim 7, wherein said pulse shaping means, said control means and at least said buffer means and said voltage detecting means are formed as an integrated circuit having a first input terminal connected to said pulse shaping means and at which said pulse signal is received and a second input terminal via which said buffer means and said voltage detecting means are connected to said capacitor, which is provided outside said integrated circuit.

9. A digital control circuit according to claim 8, wherein said discharge means is formed as part of said integrated circuit and is connected to said second input terminal.

10. A digital control circuit according to claim 1, wherein said voltage detecting means includes first means for generating said second signal when the voltage level of said capacitor is lower than a first predetermined voltage and second means for generating said second signal when the voltage level of said capacitor is higher than a second predetermined voltage which is higher than said first predetermined voltage.

11. A digital control circuit comprising control means including a pulse counting circuit providing outputs at different times for controlling the performance of a sequence of operations of a load; a first voltage source connected to said control means as a power supply; a second voltage source connected to said control means for supplying a clock pulse signal of predetermined magnitude to said pulse counting circuit to control the operation thereof; means including a capacitor connected to said second voltage source for causing said capacitor to be charged by said clock pulse signal to a voltage level determined by the magnitude of the pulses of said clock pulse signal; voltage detecting means connected to said capacitor for detecting the voltage of said capacitor and for generating a control signal when the charged voltage of said capacitor is unequal to a preset voltage; and means connected to said voltage detection means for controlling said pulse counting circuit to prevent the performance of said sequence of operations of said load in response to receipt of said control signal.

12. A digital control circuit according to claim 11 wherein said control means includes means responsive to said control signal for inhibiting operation of said pulse counting circuit.

13. A digital control circuit according to claim 11, including discharge means including a discharge resistor connected in parallel to said capacitor for holding the charge on said capacitor at said predetermined level when said capacitor is receiving said clock signal of predetermined magnitude.

14. A digital control circuit according to claim 13, wherein said discharge means further comprises means for discharging said capacitor when the magnitude of said clock pulse signal falls below said predetermined magnitude.

15. A digital control circuit according to claim 11 wherein said control means is formed as an integrated circuit.

* * * * *